US005871256A

United States Patent [19]

Kogai

[11] Patent Number: 5,871,256

[45] Date of Patent: Feb. 16, 1999

[54] METHOD FOR INCLINING A CHAIR SEAT AND CHAIR HAVING AN INCLINABLE SEAT

[75] Inventor: Koichi Kogai, Nagoya, Japan

[73] Assignee: AICO Co., Ltd., Nagoya, Japan

[21] Appl. No.: 899,115

[22] Filed: Jul. 23, 1997

[30] Foreign Application Priority Data

Mar. 31, 1997 [JP] Japan ..... 9-096421

[51] Int. Cl.[6] ..... A47C 3/00

[52] U.S. Cl. ..... 297/300.2; 297/316; 297/319

[58] Field of Search ..... 297/300.2, 300.1, 297/300.5, 300.6, 316, 319, 320, 340

[56] References Cited

U.S. PATENT DOCUMENTS

| | | | |
|---|---|---|---|
| 1,335,379 | 3/1920 | Lee | 297/319 |
| 2,083,838 | 6/1937 | Goenen | 297/316 X |
| 3,092,415 | 6/1963 | Schliephacke . | |
| 4,640,547 | 2/1987 | Fromme . | |
| 4,640,548 | 2/1987 | Desanta . | |
| 4,966,411 | 10/1990 | Katagiri et al. . | |
| 5,029,940 | 7/1991 | Golynsky et al. . | |
| 5,605,376 | 2/1997 | Kogai . | |

FOREIGN PATENT DOCUMENTS

| | | | |
|---|---|---|---|
| 2026929 | 12/1970 | Germany | 297/319 |

*Primary Examiner*—Laurie K. Cranmer
*Attorney, Agent, or Firm*—Wenderoth, Lind & Ponack, L.L.P.

[57] ABSTRACT

The disclosure relates to a method for inclining a chair seat and a chair having an inclinable seat for which maintenance can be easily carried out from outside the attaching frame of a chair, wherein the attaching frame is applicable to leg portions of various kinds of chairs. According to the method and the chair for inclining a backrest side of a seat by causing the backrest to be inclined rearwardly, the structure is such that by rearwardly inclining the backrest attached to a backrest attaching member pivotally supported so as to be inclined rearwardly at one side of an attaching frame opened downward and including a top plate 18 and side plates fixed at the upper end of a leg portion, a tip end protruding part of the backrest attaching member is caused to protrude above the attaching frame and is brought into contact with and pushes up the rear, backrest side of a seat receiving plate which is pressed toward said attaching frame and is inclinably attached to a front end of the attaching frame. In this manner, the backrest side of the seat attached to the seat receiving plate is inclined upward.

4 Claims, 9 Drawing Sheets

METHOD FOR INCLINING A CHAIR SEAT AND CHAIR HAVING AN INCLINABLE SEAT

BACKGROUND OF THE INVENTION

The present invention relates to a method for inclining a chair seat, by which the backrest side of a seat is upwardly inclined when being seated, and to a chair having an inclinable seat.

Conventionally, a method for inclining a chair seat and a chair having an inclinable seat, which are disclosed in U.S. Pat. No. 5,605,376 (Feb. 25, 1997) previously filed by the present applicant, have been known as an example of this kind of a chair seat.

This example is such that a backrest attaching member is pivotally supported so as to be inclined at one side of the attaching frame opened upward and consisting of a bottom plate and side plates and is pressed to the bottom plate side of the attaching frame, wherein a seat receiving plate is inclinably pivotally supported at the other side of the attaching frame so that the back attached to the backrest attaching member is caused to incline rearwardly. Thereby a push-up member existing at the tip end of the backrest attaching member causes the seat attached to the seat receiving plate to be upwardly inclined along with the seat receiving plate.

In conventional examples, since the attaching frame which is upwardly opened is used, in a case where attaching and tightening means such as bolts, nuts, screws, pins, etc. of components are loosened or come off, it is necessary that the seat is removed from the seat receiving plate and the seat receiving plate is further removed from the attaching frame, and thereafter the attaching and tightening means are tightened and fixed. That is, no maintenance can be carried out from the outside of the attaching frame, that is, as it is assembled. This would cause a problem in maintenance.

Furthermore, a taper bushing or a straight bushing is welded to the attaching frame and is fixed there for fixing the tip end of the supporting column of the chair leg to the attaching frame. That is, this fixing member can meet the leg of only one kind of chair. It is impossible to replace the fixing member attached and fixed at the attaching frame, and it is impossible to meet the legs of various kinds of chairs having parts and supporting column, the sizes of which are different from each other. This would cause another problem.

SUMMARY OF THE INVENTION AND ADVANTAGES

In view of the foregoing shortcomings, it is therefore an object of the invention to provide a method for inclining a chair seat and chair having an inclinable seat, which is applicable to legs of various kinds of chairs and for which the maintenance can be easily carried out from outside of its attaching frame.

That is, according to the invention the backrest side of a seat is inclined by causing the backrest to be rearwardly inclined. By rearwardly inclining the backrest attached to the backrest attaching member pivotally supported so as to be rearwardly inclined at one side of the attaching frame opened downward and including a top plate and side plates fixed at the upper end of the leg portion, the tip end protruding part of the backrest attaching member is caused to protrude through the top plate of the attaching frame and is brought into contact with and pushes up the rear, backrest side of a seat receiving plate pressed toward the top plate side of the attaching frame to thereby cause the backrest side of the seat attached to the seat receiving plate to be upwardly inclined. As necessary, a fixing member, the inner diameter of which corresponds to the leg portion, is detachably attached to the fixing portion of the leg portion and to the attaching frame. The fixing member can be replaced, in order to enable the attaching frame to be attached to a leg portion of various other chairs.

A chair according to the invention is such that the backrest side of the seat is upwardly inclined by causing the backrest to be inclined rearwardly. An attaching frame opens downward, including a top plate and side plates and, is attached to the upper end of a supporting column extending from a leg portion, a backrest attaching plate, the tip end of which has a protrusion part is pivotally supported at one side of the attaching frame so as to be inclinable. A seat receiving plate is attached to the top plate at the other side of the attaching frame so as to be upwardly inclinable and to be pressed toward the top plate side of the attaching frame while the backrest is attached to the backrest attaching member and a seat is attached to a seat receiving plate. By causing the backrest to be rearwardly inclined, the tip end protrusion part of the backrest attaching frame is caused to protrude through an opening of the top plate of the attaching frame and is brought into contact with and pushes up the rear side of the seat receiving plate. In this manner the seat is inclined upwardly. As that as necessary, a fixing member, the inner diameter of which corresponds to the leg portion, is attached to the fixing portion of the leg portion and to the attaching frame. This fixing member can be replaced, in order to enable the attaching frame to be attached to a leg portion of various other chairs.

With a method for inclining a chair seat and chair having an inclinable seat according to the invention, in a case where a fixing means such as bolts, nuts, screws, pins, etc., of the respective components are loosened or come off, it is possible to easily carry out maintenance from the outside (downward) of the attaching frame as they are assembled, without removing the seat receiving plate from the attaching frame since the attaching frame to which a seat inclining means is internally provided is opened downward.

Furthermore, since a seat inclining mechanism is of a simple structure consisting of an attaching frame, a seat receiving plate pressed toward the attaching frame side, and a backrest attaching member, the number of steps of production can be decreased, and the production time can be shortened, whereby the production cost can be remarkably decreased.

Further more, since the backrest of the seat is upwardly inclined in line with a rearward inclination of the backrest, the backbone of a person being seated is straightened and elongated and the heels of the person are not caused to float above the floor level. Therefore, the calves can be freed from any strain and the load of a person being seated can be dispersed to the entirety of the rear side of the femoral region. Therefore, a sense of pressure at the rear side of the femoral region in the vicinity of the knees can be cancelled to cause the circulation of the blood to be much improved and sensitivity to the cold to be eliminated.

Since a fixing member, the inner diameter of which corresponds to the supporting column of the leg portion, is detachably attached to the fixing portion of the leg portion and attaching frame, only replacement of the fixing member causes the attaching frame to be applicable to a leg portion of various kinds of chairs.

BRIEF DESCRIPTION OF THE DRAWINGS

Other features and advantages of the invention will be apparent from the following description taken in conjunction with the accompanying drawing wherein.

DETAILED DESCRIPTION OF THE PREFERRED EMBODIMENTS

Figure 1:
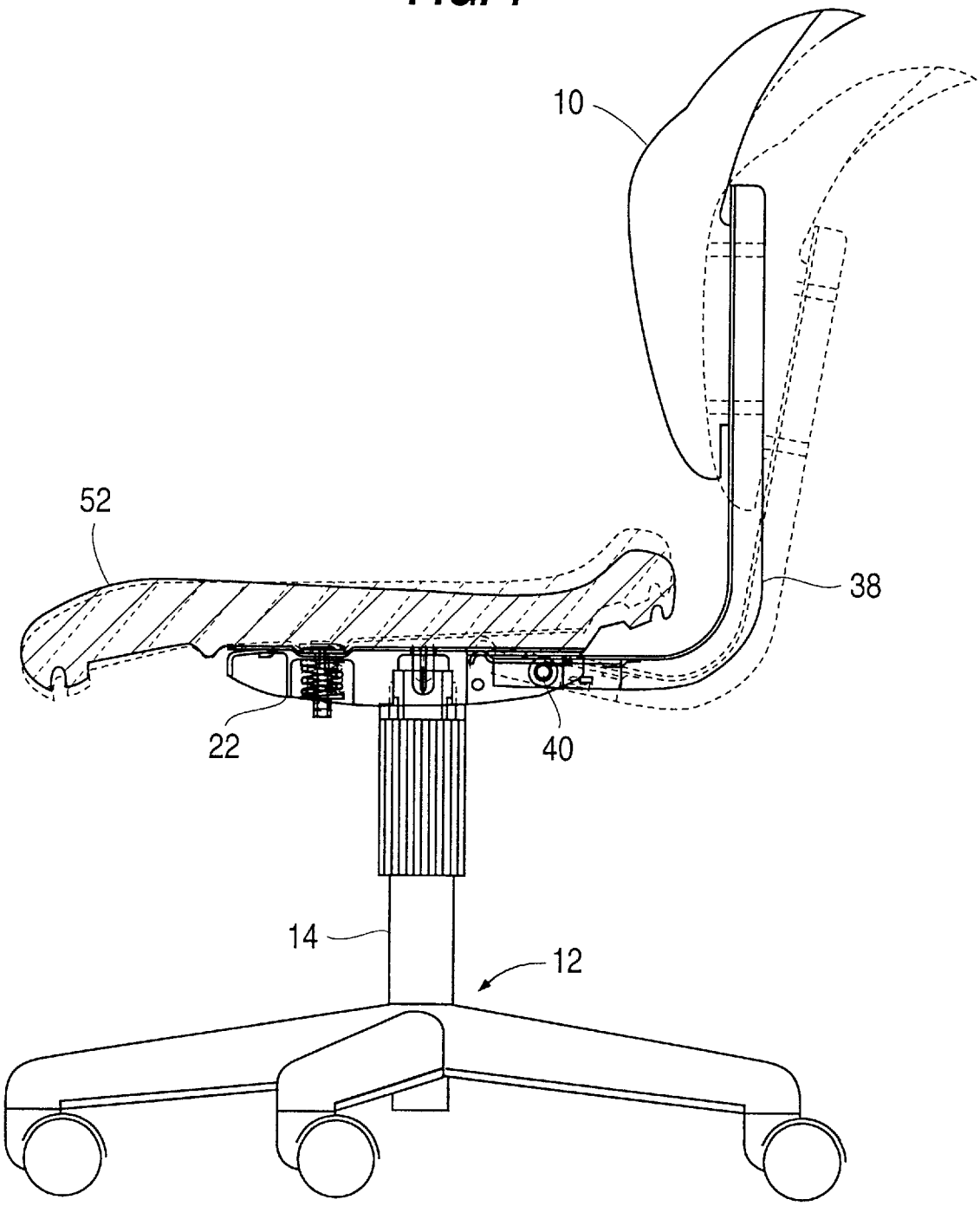
FIG. 1 is a partially broken front elevational view of a chair seat equipped with an inclinable seat according to the invention.
Figure 2:
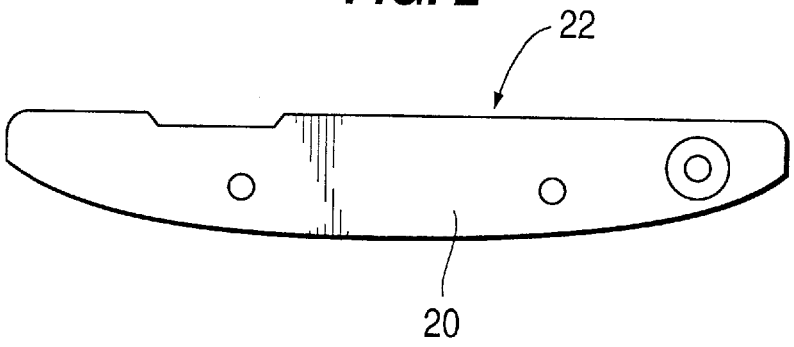
FIG. 2 is a front elevational view of an attaching frame.
Figure 3:
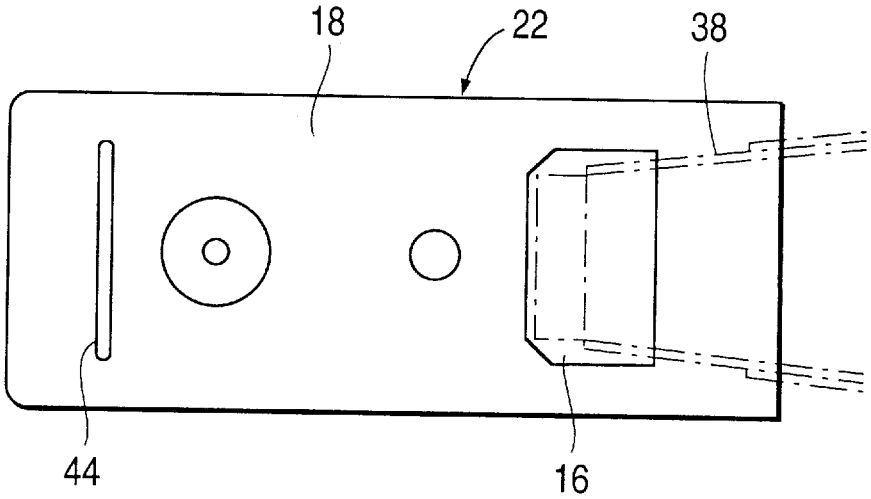
FIG. 3 is a plan view of the attaching frame.
Figure 4:
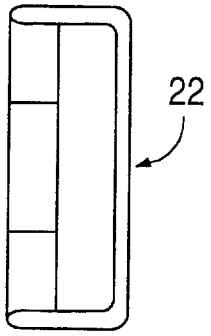
FIG. 4 is a right-side elevational view of the attaching frame.
Figure 5:
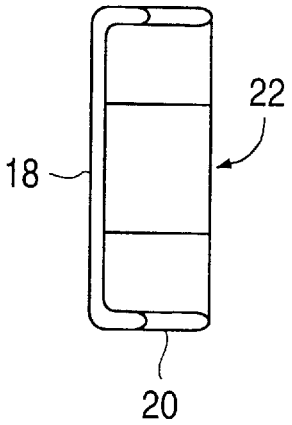
FIG. 5 is a left-side elevational view of the attaching frame.
Figure 6:
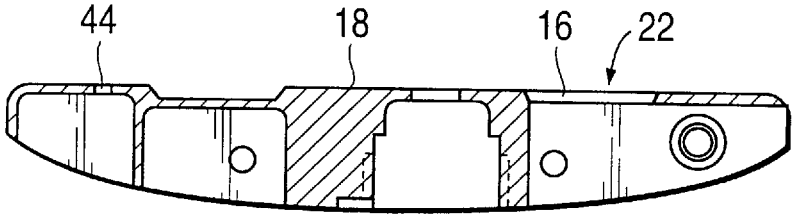
FIG. 6 is a longitudinally sectional view of the attaching frame.
Figure 7:
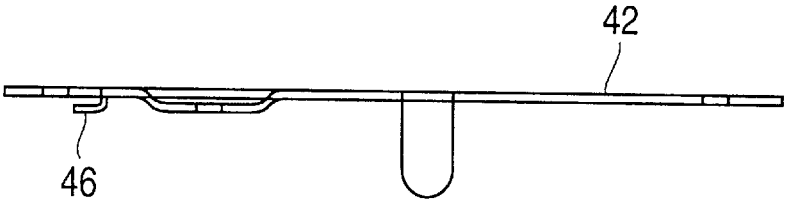
FIG. 7 is a front elevational view of a seat receiving plate.
Figure 8:
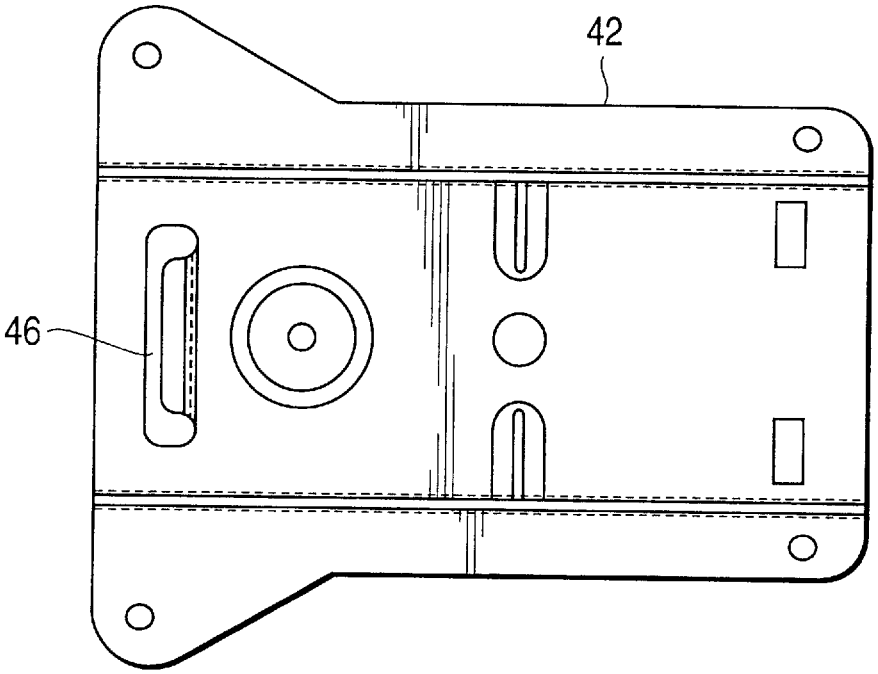
FIG. 8 is a plan view of the seat receiving plate.
Figure 9:
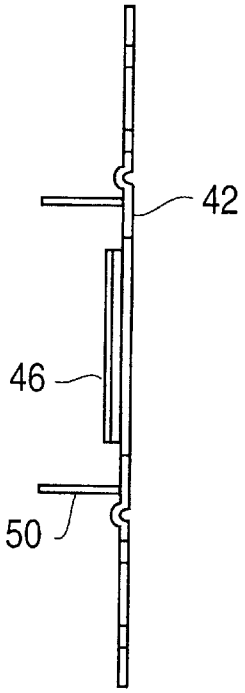
FIG. 9 is a right-side elevational view of the seat receiving plate.
Figure 10:
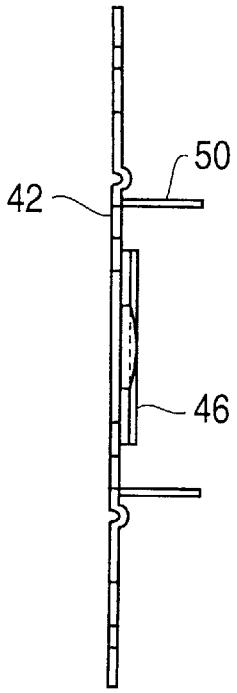
FIG. 10 is a left-side elevational view of the seat receiving plate.
Figure 11:
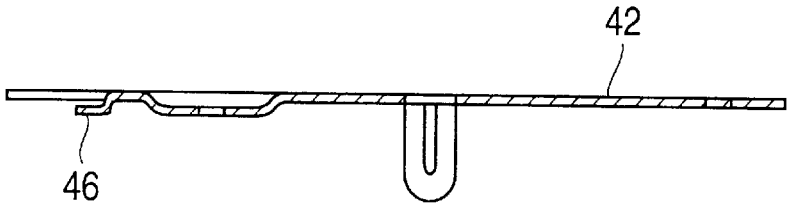
FIG. 11 is a longitudinally sectional view of the seat receiving plate.
Figure 12:
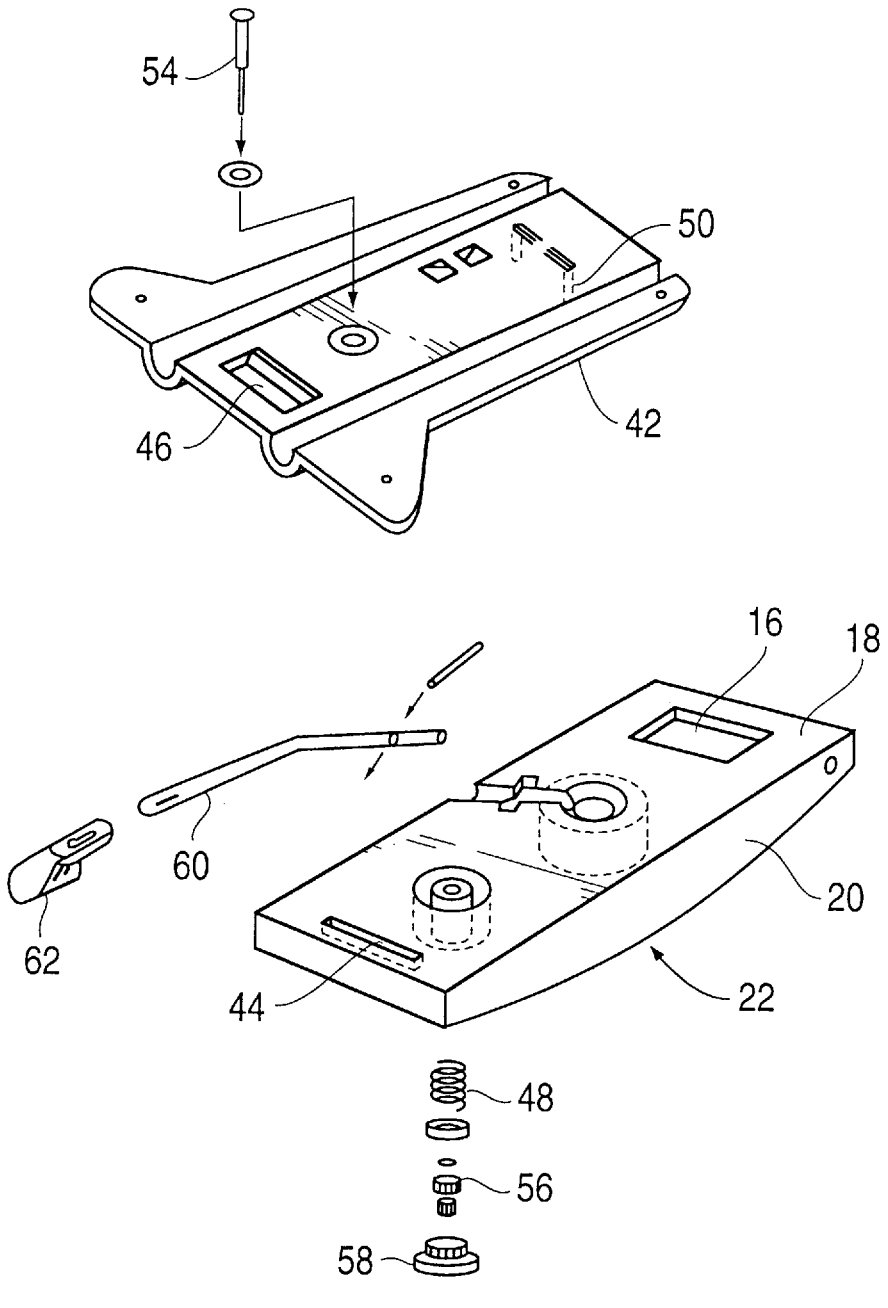
FIG. 12 is a disassembled perspective view showing an assembled state of the attaching frame and seat receiving plate.
Figure 13:
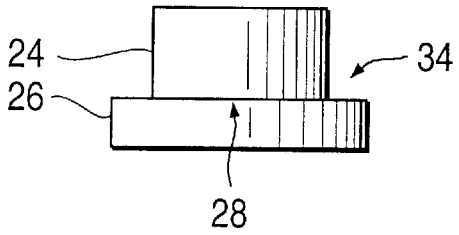
FIG. 13 is a front elevational view of fixing member.
Figure 14:
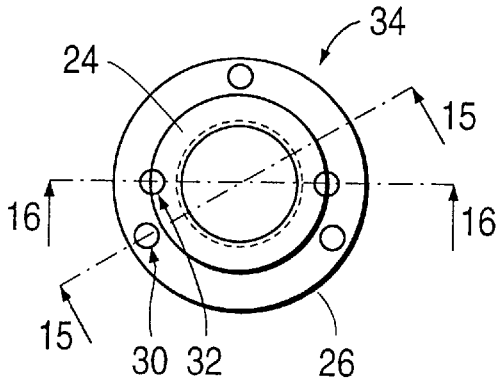
FIG. 14 is a plan view of the fixing member.
Figure 15:
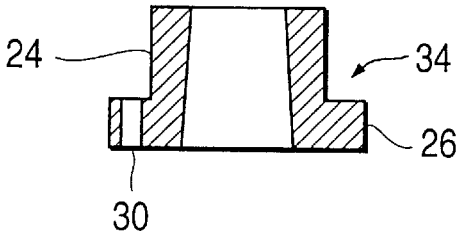
FIG. 15 is a cross-sectional view taken along line 15—15 in FIG. 13.
Figure 16:
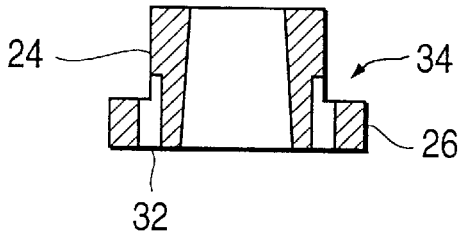
FIG. 16 is a cross-sectional view taken along line 16—16 in FIG. 13.
Figure 17:
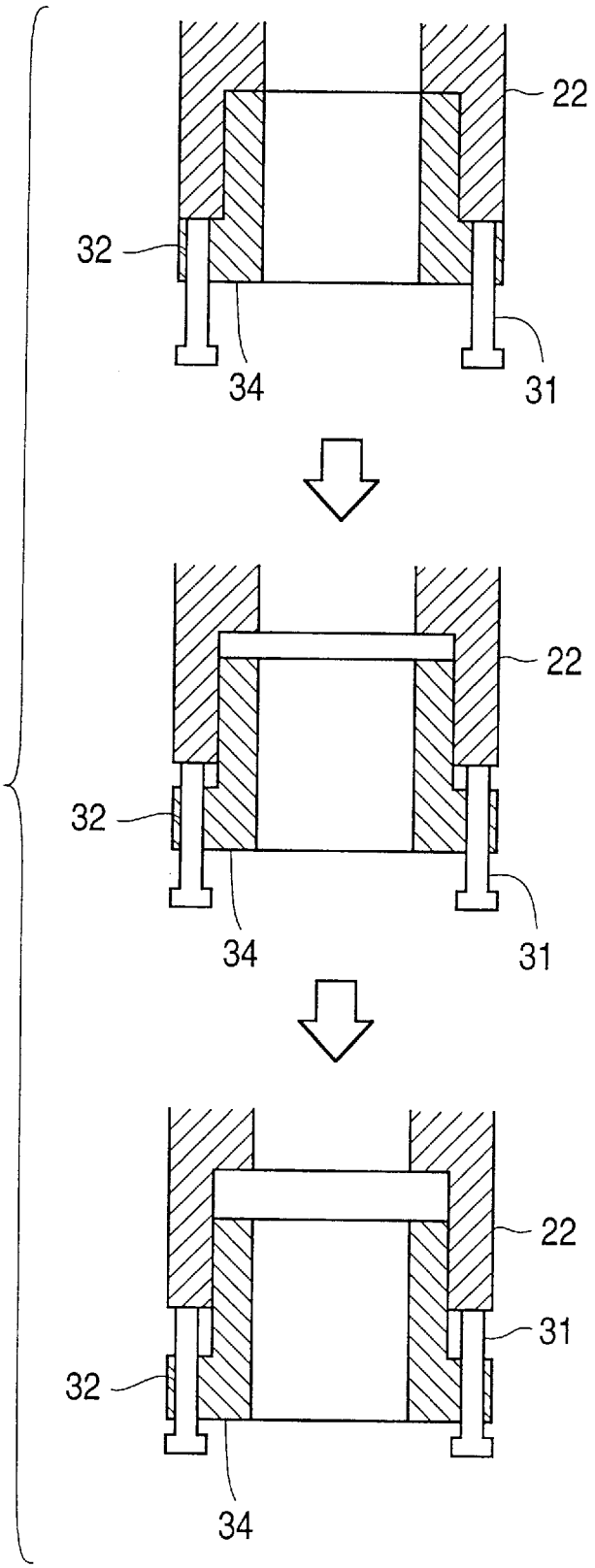
FIG. 17 is a front sectional view showing a removing process.
Figure 18:
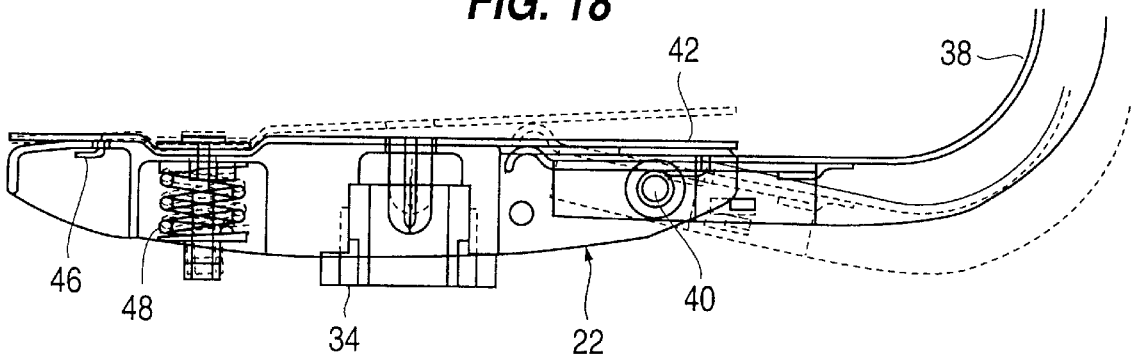
FIG. 18 is an enlarged front elevational view of major parts of the invention.
Figure 19:
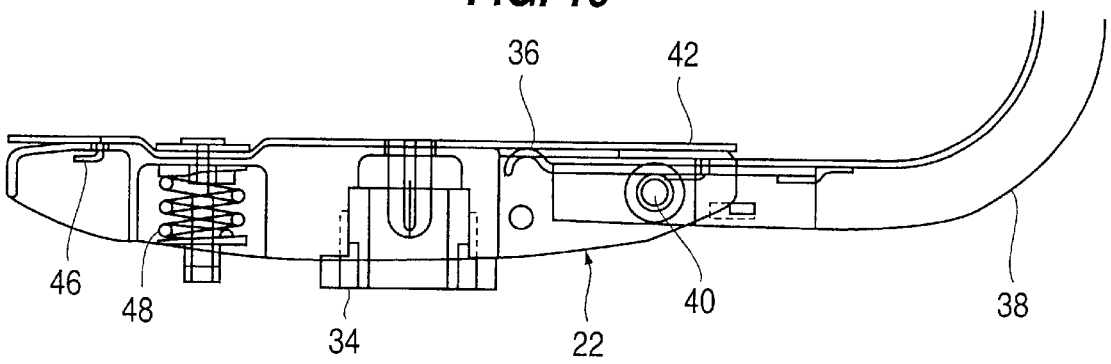
FIG. 19 is an enlarged front elevational view of major parts, showing a state where the fixing member is not used.
Figure 20:
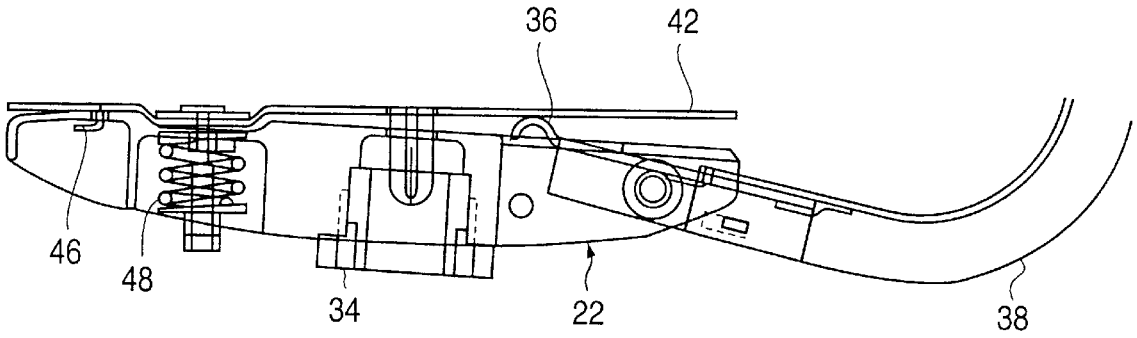
FIG. 20 is an enlarged front elevational view of major parts, showing a state where the fixing member is used.

A chair having an inclinable chair seat according to the invention is such that a backrest 10 is made rearwardly inclinable. As shown in FIG. 1 through FIG. 20, the chair is composed as described below.

A leg portion 12 of the chair used for the invention internally has an elevation and lowering mechanism such as a gas spring, a screw mechanism, etc.

An attaching frame 22 opened downward and consisting of a plate-like top plate 18 on which an opening 16 is formed, and plate-like side plates 20 attached onto the upper end of a supporting column 14 extending from the leg portion 12.

A protrusion portion 36 at the tip end of a backrest attaching member 38 is caused to protrude through the opening 16 of the top plate 18 and is brought into contact with the rear side of a seat receiving plate 42. The protrusion portion 36 pushes up the seat receiving plate 42 to thereby Cause a seat 52 attached to the seat receiving plate 42 to be upwardly inclined. A guide piece 50 secured at the seat receiving plate 42, which is used for guiding the seat receiving plate when inclining the same upwards, is inserted into the opening 16 of the top plate 18.

As shown in FIG. 13 through FIG. 17, a fixing member 34 is such that an attaching hole 30 is provided in the vertical direction a second cylindrical member 26 of a body 28 consisting of a first cylindrical member 24 and the second cylindrical member 26, located below the first cylindrical member 26. The diameter of the second cylindrical member 26 is larger than that of the first cylindrical member 24, and a removing hole 32 is drilled in the vertical direction of the connection part connecting the first cylindrical member 24 with the second cylindrical member 26. The fixing member 34 is attached to the fixing potion of the leg portion 12 and attaching frame 22.

In this example, in a case where the fixing member 34 is attached to the attaching frame 22, a screw 31 is inserted into the attaching hole 30, and the attaching frame is screwed therein. In a case where the fixing member 34 is removed from the attaching frame 22, after the screw 31 is removed from the attaching frame 22, the screw 31 is screwed in the removing screw hole 32 of the fixing member 34, whereby the fixing member 34 inserted into and fitted to the attaching frame 22 is spaced and removed from the attaching frame 22.

By replacing this fixing member 34, it is possible to apply the attaching frame 22 to the leg portion 12 of various kinds of chairs even though the diameters of the supporting column 14 of the leg portion 12 are different. That is, if a plurality of fixing members having different inner diameters are prepared, it is possible to apply the attaching frame 22 to a leg portion 12 of a number of chairs (See FIG. 17).

The backrest attaching member 38 having the protrusion portion 36 formed at its tip end is pivotally supported at one side of the attaching frame 22 so as to be inclinable rearwardly.

In this example, the backrest attaching member 38 is roughly L-shaped, and a supporting pin 40 is used to pivotally support the backrest attaching member 38 on the attaching frame 22.

The seat attaching plate 42 is attached onto the top plate 18 at the other side of the attaching frame 22 and simultaneously is pressed toward the top plate 18 side of the attaching frame 22.

In this example, the seat receiving plate 42 is attached to the top plate 18 of the attaching frame 22 by causing an L-shaped engaging piece 46, which protrudes to the rear side of the seat receiving plate 42, to be fixed in a slit-like engaging hole 44 formed in the top plate 18.

By the attaching means, the clearance between the upper surface of one side of the attaching frame 22 and the rear side at one side of the seat receiving plate 42 is minimized, whereby the inclination distance (height) from the top plate 18 of the attaching frame 22 to the seat receiving plate 42 can be controlled so as to be decreased.

Furthermore, by causing the rear side at one side of the seat receiving plate 42 to be brought into contact with the upper surface of one side of the attaching frame 22, the upward inclination of the seat receiving plate 42 is caused to stop, whereby the seat receiving plate 42 is prevented from further upward inclination.

In this example, a means for pressing the seat receiving plate 42 toward the top plate 18 side of the attaching frame 22 is a coil spring 48.

Furthermore, A guide piece 50 is caused to protrude downward at a position corresponding to the opening 16 of the top plate 18 of the attaching frame 22 of the seat receiving plate 42.

A backrest 10 is attached to the backrest attaching member 38, and a seat 52 is attached to the seat receiving plate 42.

Still furthermore, in the drawings, 54 is a supporting bolt, 56 is a fixing nut, 58 is a cap, 60 is an elevating and lowering lever, and 62 is a lever knob.

A description will be given of a method for inclining a chair seat according to this example.

By causing the backrest 10 to be rearwardly inclined against a pressing force (resiliency of the coil spring 48) acting toward the top plate 18 side of the attaching frame 22 of the seat receiving plate 42, the protrusion part 36 at the tip end of the backrest attaching member 38 protrudes through the opening 16 of the top plate 18 of the attaching frame by the lever principle, and the protrusion portion 36 at the top end of the backrest attaching member 38 is brought into contact with and pushes up the rear side of the seat receiving member 42 at the backrest 10 side. In this manner the seat receiving member 42 and seat 52 are upwardly inclined about 3 degrees (the angle considered to be the most suitable) with the axial supporting part of the attaching frame 22 made a fulcrum, and the angle of the back becomes a conventional 8 to 10 degrees, thereby further improving a seating comfort of a person being seated with his back fitted to the backrest.

Furthermore, since the seat receiving plate 42 is pressed toward the top plate 18 side of the attaching frame 22 when the backrest 10 is rearwardly inclined, the protrusion portion 36 at the tip end of the backrest attaching member 38 to which the backrest 10 is attached is pressed to the attaching frame 22 side, wherein the backrest 10 is pressed forward, and the heavier the weight of a person being seated is, the stronger the resiliency, which results from a forward pressing of the backrest 10. Thereby, the operating force (load of the back) of the backrest against the back of a person being seated is increased, and the lighter the weight of a person being seated is, the less the resiliency operates to cause the operating force (the load of the back) of the backrest against the back of a person being seated to be decreased. Therefore, since the operating force of the backrest against the back of a person being seated fixedly operates in response to the weight of a person being seated, he will never feel that the backrest is too soft or too hard. Accordingly, the seating comfort is remarkably improved.

Therefore, since the backbone of a person being seated can be straightened and elongated and the person's heel is not caused to float above the floor level, the calves can be freed from any strain and the load of a person being seated can be dispersed to the entirety of the rear side of the femoral region. Therefore, a sense of pressure at the rear side of the femoral region in the vicinity of the knees can be cancelled to cause the circulation of the blood to be much improved and sensitivity to the cold to be eliminated.

Still furthermore, in this example, a pivotal supporting means of the seat receiving plate 42 and attaching frame 22 is such that an L-shaped engaging piece 46 projecting from the rear side at one side of the seat receiving plate 42 is engaged in a slit-like engaging hole 44 secured at the top plate 18 of the attaching frame 22. However, a pin may be employed instead thereof, and other pivotally supporting means by which the seat receiving plate 42 is inclinable upwards with respect to the attaching frame 22 may also be employed.

Still furthermore, a seat rear cover may be freely attached downward of the outside of the attaching frame 22.

What is claimed is:

1. A method for inclining a chair seat, wherein inclining of a backrest side (10) of a seat (52) causes a backrest (10) to be inclined rearwardly, said method comprising rearwardly inclining the backrest (10) attached to a backrest attaching member (38) pivotally supported so as to be inclined rearwardly at a first side of an attaching frame (22) which opens downward, includes top plate (18) and side plates (20) and is fixed at an upper end of a leg portion (12), so as to cause a tip end protruding part (36) of said backrest attaching member (38) to protrude through said top plate (18) of said attaching frame (22) while said tip end protruding part (36) is brought into contact with and pushes up a rear, backrest side of a seat receiving plate (42) of which a front side is pressed toward a top plate (18) side of said attaching frame (22) and is inclinable attached to a second side of said attachment frame to thereby cause said backrest (10) side of said seat (52) attached to said seat receiving plate (42) to be inclined upward.

2. A method for inclining a chair seat as set forth in claim 1, wherein a fixing member (34), an inner diameter of which corresponds to said leg portion (12), is detachably attached to a fixing portion of said leg portion (12) and to said attaching frame (22), and by replacing said fixing member (34) with one of a plurality of fixing members corresponding to leg portions of various other chairs, said attaching frame (22) can be attached to a leg portion of one of the various other chairs.

3. A chair having an inclinable seat, wherein a backrest (10) side of a seat (52) is upwardly inclined by causing said backrest (10) to be rearwardly inclined, said chair comprising: an attaching frame (22) which opens downward, includes a top plate (18) and side plates (20), and is attached to an upper end of a supporting column (14) extending from a leg portion (12); a backrest attaching plate (38), having a tip end protrusion part (36), (22) so as to be rearwardly inclinable; a seat receiving plate (42) attached to said top plate (18) at a second side of said attaching frame (22) so as to be upwardly inclinable and so as to be pressed toward a top plate side of said attaching frame (22) while the backrest (10) is attached to said backrest attaching member (38) and the seat is attached to said seat receiving plate (42); wherein by causing said backrest (10) to be rearwardly inclined, the tip end protrusion part (36) of said backrest attaching frame (38) is caused to protrude through an opening (16) formed in said top plate (18) of said attaching frame (22) and is brought into contact with and pushes up a rear, backrest side of said seat receiving plate (42), thereby causing said seat (52) to be upwardly inclined.

4. A chair having an inclinable seat as set forth in claim 3, further comprising a replaceable fixing member (34) having an inner diameter which corresponds to a supporting column (14) of a leg portion (12), and which is attached to a fixing portion of said leg portion and to said attaching frame, whereby, by replacing said replaceable fixing member (34) with one of a plurality of fixing members corresponding to leg portions of various other chairs, said attaching frame (22) can be attached to a leg portion of one of the various other chairs.

* * * * *